US005114669A

United States Patent [19]

Cockayne et al.

[11] Patent Number: 5,114,669

[45] Date of Patent: May 19, 1992

[54] FERROMAGNETIC MATERIALS

[75] Inventors: Brian Cockayne; William R. MacEwan, both of Worcestershire; Ivor R. Harris, Birmingham; Nigel A. Smith, West Midlands, all of United Kingdom

[73] Assignee: The Secretary of State for Defence in Her Britannic Majesty's Government of the United Kingdom of Great Britain and Northern Ireland, Whitehall, England

[21] Appl. No.: 623,981

[22] PCT Filed: Apr. 14, 1989

[86] PCT No.: PCT/GB89/00381

§ 371 Date: Dec. 13, 1990

§ 102(e) Date: Dec. 13, 1990

[87] PCT Pub. No.: WO89/10620

PCT Pub. Date: Nov. 2, 1989

[30] Foreign Application Priority Data

Apr. 28, 1988 [GB] United Kingdom ..... 8810125

[51] Int. Cl.[5] ..... C22C 38/00

[52] U.S. Cl. ..... 420/8; 420/581; 420/72; 148/306; 148/314; 148/315

[58] Field of Search ..... 148/306, 314, 315, DIG. 56; 420/581, 72, 8

[56] References Cited

U.S. PATENT DOCUMENTS 3,126,346 3/1964 Bither ..... 148/306

FOREIGN PATENT DOCUMENTS 442549 1/1968 Switzerland .
932678 7/1963 United Kingdom .
1525959 9/1978 United Kingdom .

OTHER PUBLICATIONS

Harris et al., "Structural, Magnetic and Constitutional Studies of a New Family of Ternary Phases Based on the Compound $Fe_3GaAs$", J. of the Less Common Metals 146 (1989), pp. 103 to 119.

Harris et al., "Phase Identification in Fe Doped GaAs Single Crystals", J. of Crystal Growth, 82 (1987) 450–458.

*Primary Examiner*—John P. Sheehan

*Attorney, Agent, or Firm*—Nixon & Vanderhye

[57] ABSTRACT

A ferromagnetic material having the formula $MGa_{2-x}As_x$ where $0.15 \leqq x \leqq 0.99$ and M represents one of $Fe_3$, $Fe_3$ partially substituted by manganese or $Fe_3$ partially substituted by cobalt.

15 Claims, 4 Drawing Sheets

FERROMAGNETIC MATERIALS

This invention relates to ferromagnetic materials.

Ferromagnetic materials display a marked increase in magnetisation in an independently established magnetic field. Ferromagnetic materials may be used in a wide variety of uses including motors or galvanometers. The temperature at which ferromagnetism changes to paramagnetism is defined as the Curie Temperature, $T_c$.

Ferromagnetic materials based on rare earth elements may have Curie Temperatures up to 700°-800° C., but they oxidise [Goldschmidt Report Reviews Information 4/75 no. 35 and 2/79 no. 48]. The inclusion of iron within an alloy is a well established possible method of producing a ferromagnetic material. $Nd_2Fe_{14}B$ has one of the highest reported Curie Temperatures (315° C.) of rare earth-iron based alloys. Iron may in turn be used to dope GaAs in order to produce a material with ferromagnetic properties. One of the most recent reports of such material is that of I. R. Harris et al. in the Journal of Crystal Growth 82 pp 450–458 1987. This publication reported the growth of $Fe_3GaAs$ as a ferromagnetic material (Curie Temperature=about 100° C.) and discussed this alloy with reference to previous work carried out on iron doped GaAs.

The present invention provides an improved stable ferromagnetic GaAs based material with an increased Curie Temperature.

According to this invention a ferromagnetic material comprises Ga and As and a balance apart from impurities of M, having a formula $M_3Ga_{2-x}As_x$ where x has the range $0.15 \leqq x \leqq 0.99$ and where M represents iron or a component of the ferromagnetic material where iron is partially substituted by manganese.

Where $M_3$ represents $Fe_3$ and x is a value within the continuous range $0.15 \leqq x \leqq 0.99$, then x would have the preferred range of $0.15 \leqq x \leqq 0.85$. The most preferential range for x in this alloy may be expressed as $0.15 \leqq x \leqq 0.75$.

Where $M_3$ represents $Fe_3$ and the range of x is $0.21 \leqq x \leqq 0.99$, as cast material consists of single phase $Fe_3GaAs$ with an eutectic mixture at the grain boundaries. In the range $0.15 \leqq x \leqq 0.21$ for the same alloy the as cast material exhibits phases in addition to an eutectic mixture at grain boundaries.

In as cast material where $M_3$ represents $Fe_3$ and the range of x is $0.85 \leqq x \leqq 0.99$, the predominant phase is hexagonal $B8_2$-type $Fe_3Ga_{2-x}As_x$ with a minimal amount of the phase GaAs. Within the $B8_2$-type ($Ni_2In$-type) the In-type sub-lattice is filled by a combination of Ga and As atoms and three quarters of the two nickel type sites are taken up by the iron atoms.

Lattice structural transition (ordering) occurs within the composition range of $0.75 \leqq x \leqq 0.85$. The structure is still hexagonal, but there is a change of the a and c spacings such that $a_2=2a_1$ and $c_2=c_1$, where $a_1$ and $c_1$ are the a and c spacings of the $B8_2$-type structure and $a_2$ and $c_2$ are the a and c spacings of the new structure. In the composition range $0.15 \leqq x \leqq 0.75$ the ordering process is complete.

The ferromagnetic material $Fe_3Ga_{2-x}As_x$ may subsequently be variously heat treated in order to achieve higher Curie Temperatures. Suitable annealing temperatures would be between approximately 600° C. and 900° C. Where $M_3$ represents partial substitution of iron with manganese, then this substitution is used to maintain high Curie Temperatures.

BRIEF DESCRIPTION OF THE DRAWINGS

This invention will now be described by way of example only with reference to the accompanying diagrams of which.

The ferromagnetic material $M_3Ga_{2-x}As_x$ may be produced using typical methods such as casting or single crystal growth. Both methods require encapsulation of melt constituents to prevent loss of arsenic from the melt whilst in a furnace environment. Boric oxide is an example of a commonly used encapsulation material.

Figure 1:
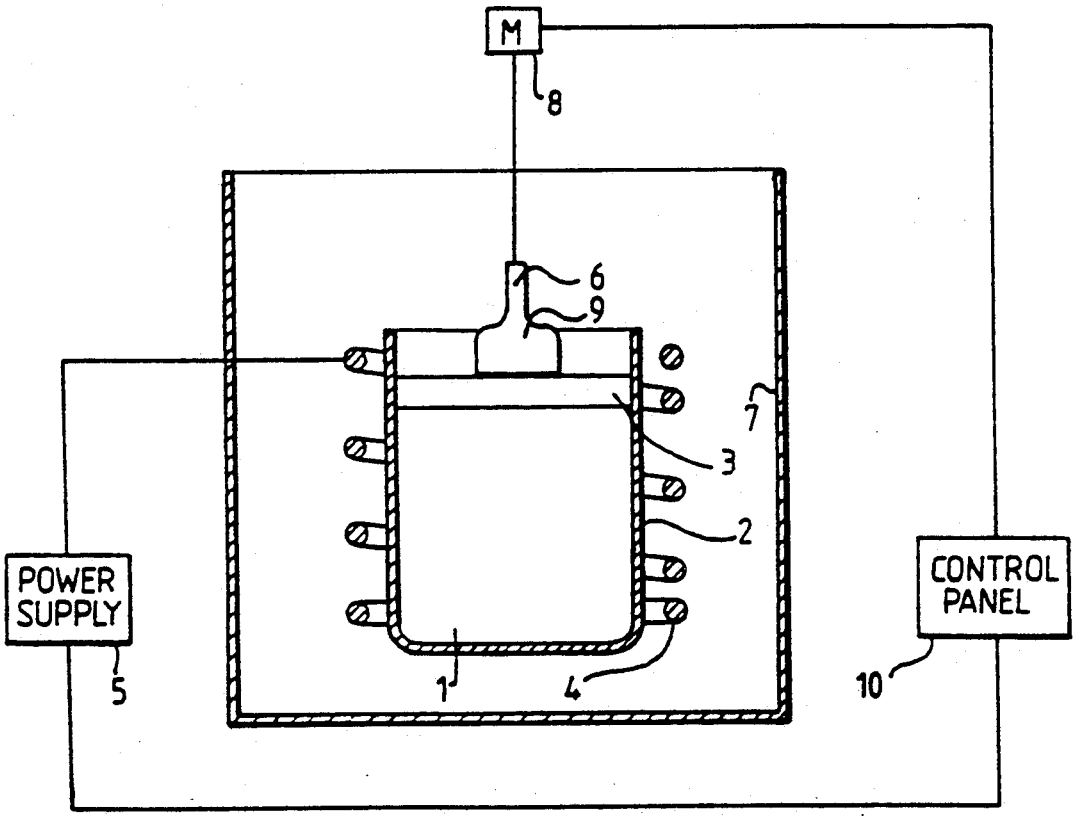
FIG. 1 is a schematic representation of Liquid Encapsulation Czochralski (LEC) growing equipment.

The Liquid Encapsulation Czochralski technique for growth of single crystal material may be used for the growth of the alloy $M_3Ga_{2-x}As_x$, and has been described in U.K. Patent Number 1 113 069. As shown in FIG. 1, the melt constituents 1 (Fe, Ga and GaAs) of applicable ratios are placed in a silica crucible 2 and covered with boric oxide 3. The crucible 2 and contents 1 are then heated by electric heaters 4 fed through a power supply 5. An orientated seed 6 is lowered into the pressurised chamber 7 by a motor 8. When the seed 6 has been partially immersed in the molten alloy 1, controlled growth takes place by rotating and retracting the seed 6 away from the melt 1, through the encapsulant 3 and into the pressurised chamber environment 7. This results in a single crystal, or near single crystal, boule 9. All growth procedures are controlled by a control panel 10.

Specific compositions will now be given by way of example only where all examples are as cast material except Example 6

EXAMPLE 1

$Fe_3Ga_{1.85}As_{0.15}$

Figure 2:
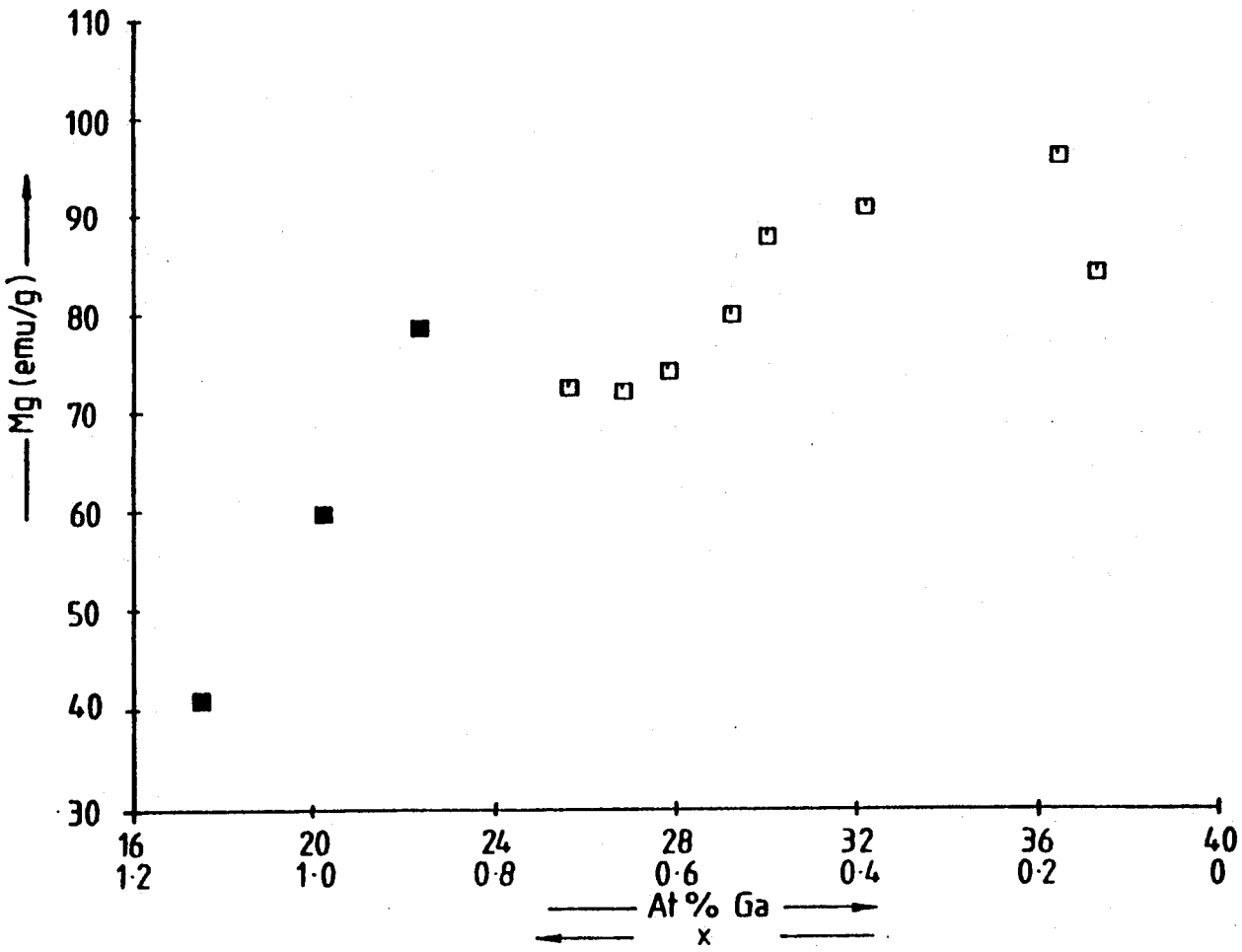
FIG. 2 is a graph of the saturation magnetisation of $M_3Ga_{2-x}As_x$ against the atomic percentage of Gallium for as cast material where $M_3$ represents $Fe_3$.
Figure 3:
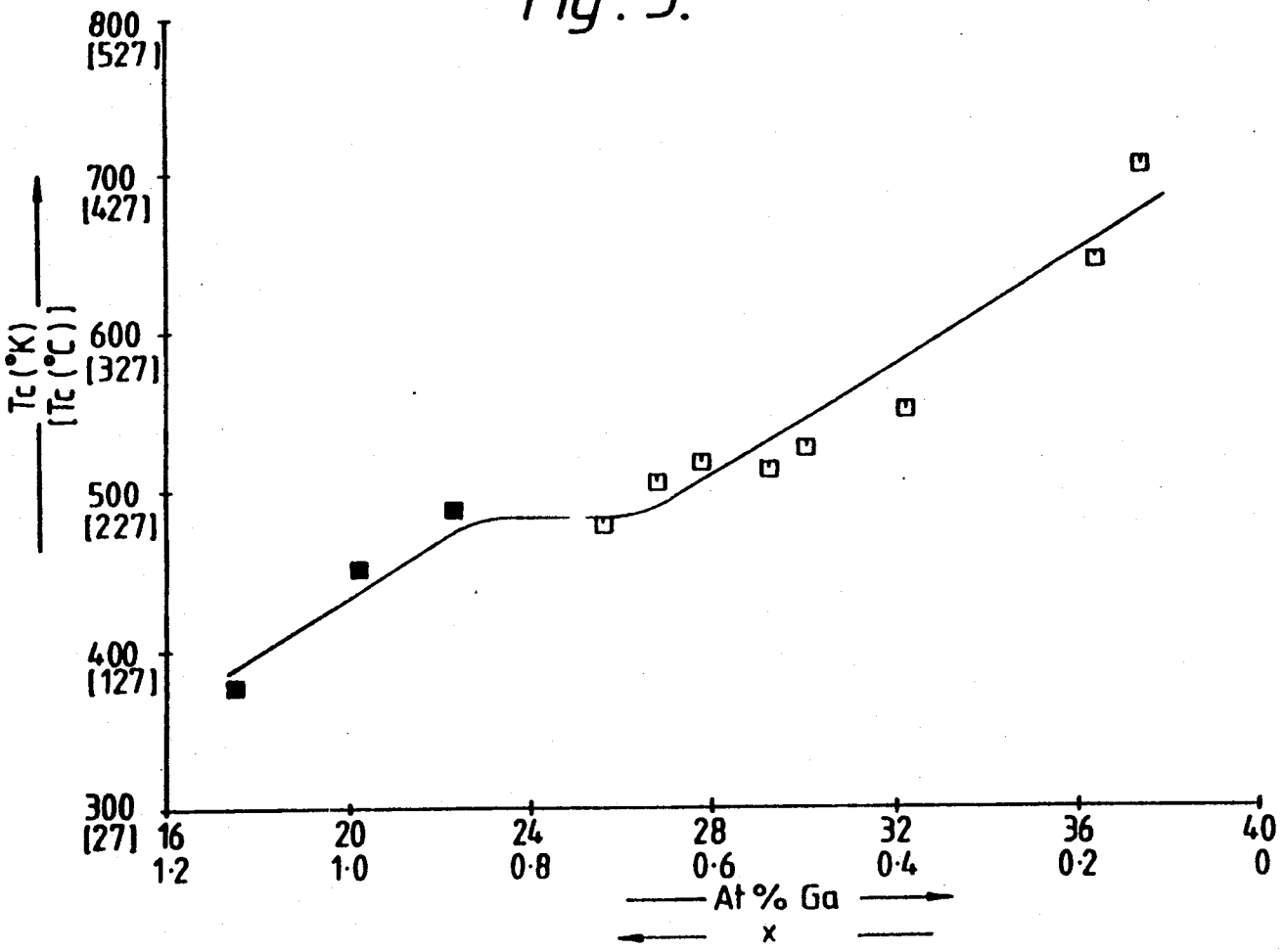
FIG. 3 is a graph of the variation in Curie Temperature with increasing Gallium content for as cast material where $M_3$ represents $Fe_3$.

This composition has a saturation magnetisation of 84 emu $g^{-1}$ at 298 K. (FIG. 2) and a Curie Temperature of 431° C. (FIG. 3).

EXAMPLE 2

$Fe_3Ga_{1.79}As_{0.21}$

Figure 4:
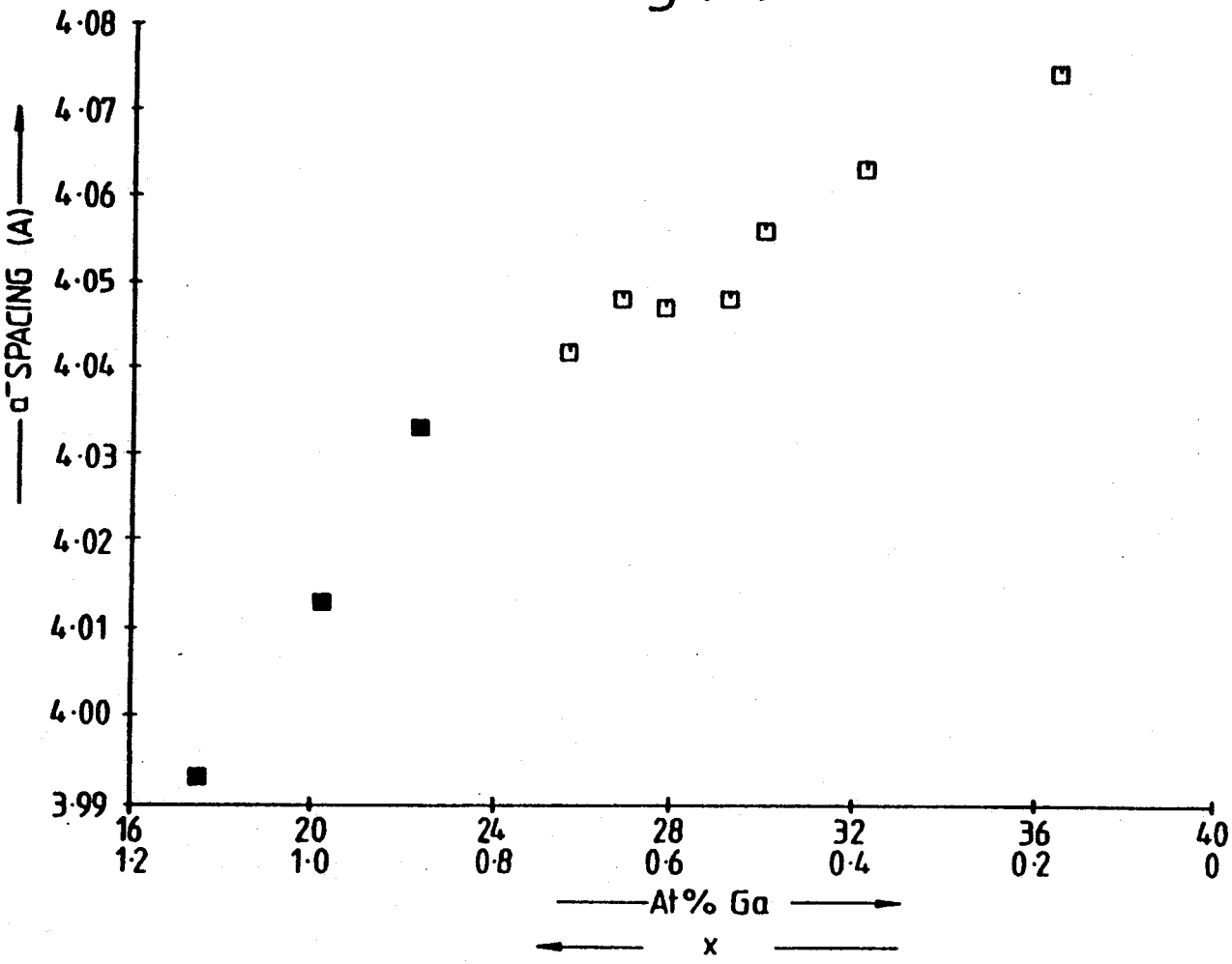
FIG. 4 is a graph of the a-spacing versus the atomic percentage of Gallium in the alloy for as cast material where $M_3$ represents $Fe_3$.

This composition has a saturation magnetisation of 97 emu $g^{-1}$ at 298 K. (FIG. 2), a Curie Temperature of 370° C. (FIG. 3) and an a-spacing of 4.07A (FIG. 4).

EXAMPLE 3

$Fe_3Ga_{1.5}As_{0.5}$

This composition has a saturation magnetisation of 88 emu $g^{-1}$ at 298 K. (FIG. 2), a Curie Temperature of 240° C. (FIG. 3) and an a-spacing of 4.055A (FIG. 4).

EXAMPLE 4

$Fe_3Ga_{1.35}As_{0.75}$

This composition has a saturation magnetisation of 72 emu $g^{-1}$ at 298 K. (FIG. 2), a Curie Temperature of 232° C. (FIG. 3) and an a-spacing of 4.048A (FIG. 4).

EXAMPLE 5

$Fe_3Ga_{1.1}As_{0.9}$

This composition has a saturation magnetisation of 79 emu $g^{-1}$ at 298 K. (FIG. 2), a Curie Temperature of 215° (FIG. 3) and an a-spacing of 4.033A.

EXAMPLE 6

$Fe_3Ga_{1.4}As_{0.6}$

Alloys may be variously heat treated to homogenise the microstructure. The heat treatment may occur within a vacuum or without a vacuum. The heat treatment may require an air, inert gas or arsenic ambient at air or other pressures, or a flowing medium of any of these. The annealing temperatures employed is dependent upon the annealing environment used and the material properties required.

This composition in the as cast state has a Curie Temperature of 244° C. After annealing the example at about 600° C. in a vacuum of $10^{-6}$ Torr for three days the Curie Temperature increases to 282° C.

EXAMPLE 7

$Fe_{2.7}Mn_{0.3}Ga_{1.85}As_{0.15}$

This composition has a saturation magnetisation of 94 emu $g^{-1}$ at 298 K. and a Curie Temperature of 416° C.

EXAMPLE 8

$Fe_{2.7}Co_{0.3}Ga_{1.85}As_{0.15}$

This composition has a saturation magnetisation of 71 emu $g^{-1}$ at 298 K. and a Curie Temperature of 346° C.

We claim:

1. A ferromagnetic material having the formula $MG_{2-x}Ga_x$ comprising Ga and As and the balance, apart from impurities, of M; where x has the range of $0.15 \leqq x \leqq 0.85$ and where M represents $Fe_3$.

2. The ferromagnetic material according to claim 1 where x has the range $0.15 \leqq x \leqq 0.75$.

3. The ferromagnetic material according to claim 1 or claim 10 where the ferromagnetic material has been annealed in a temperature range of about 600° C. to 900° C.

4. The ferromagnetic material according to claim 3 where the ferromagnetic material was annealed in a vacuum.

5. The ferromagnetic material according to claim 3 where the ferromagnetic material was annealed in an ambient atmosphere selected from air, arsenic and inert gas.

6. The ferromagnetic material according to claim 5 where the ambient atmosphere was a flowing medium.

7. The ferromagnetic material according to claim 3 where the ferromagnetic material was annealed in a vacuum of $10^{-6}$ Torr for three days at a temperature of about 600° C.

8. A ferromagnetic material having the formula $MGa_{2-x}As_x$ comprising Ga and As and the balance, apart from impurities, of M; where x has the range $0.15 \leqq x \leqq 0.99$ and where M is $Fe_3$ partially substituted by manganese or $Fe_3$ partially substituted by cobalt.

9. The ferromagnetic material according to claim 8 where x has a range $0.15 \leqq x \leqq 0.85$.

10. The ferromagnetic material according to claim 8 where x has a range $0.15 \leqq x \leqq 0.75$.

11. The ferromagnetic material according to claim 8 where the ferromagnetic material has been annealed in a temperature range of about 600° C. to 900° C.

12. The ferromagnetic material according to claim 11 where the ferromagnetic material was annealed in a vacuum.

13. The ferromagnetic material according to claim 11 where the ferromagnetic material was annealed in an ambient atmosphere selected from air, arsenic and inert gas.

14. The ferromagnetic material according to claim 13 where the ambient atmosphere was a flowing medium.

15. The ferromagnetic material according to claim 11 where the ferromagnetic material was annealed in a vacuum of $10^{-6}$ Torr for three days at a temperature of about 600° C.

* * * * *